US005079683A

United States Patent [19]

McGuire

[11] Patent Number: 5,079,683

[45] Date of Patent: Jan. 7, 1992

[54] APPARTAUS FOR PRODUCING LIGHT DISTRIBUTIONS

[75] Inventor: Kevin P. McGuire, Rochester, N.Y.

[73] Assignee: Tailored Lighting Company, Inc., Pittsford, N.Y.

[21] Appl. No.: 652,527

[22] Filed: Feb. 8, 1991

Related U.S. Application Data

[63] Continuation-in-part of Ser. No. 512,436, Apr. 19, 1990.

[51] Int. Cl.[5] ..... F21V 9/00

[52] U.S. Cl. ..... 362/293; 362/294; 362/319; 362/321; 359/889

[58] Field of Search ..... 350/315; 362/2, 228, 362/293, 294, 319, 321, 373

[56] References Cited

U.S. PATENT DOCUMENTS 4,080,050 3/1978 Huber ..... 350/315
4,811,182 3/1989 Solomon ..... 362/293
4,890,208 12/1989 Izenour ..... 362/293 X

*Primary Examiner*—Stephen F. Husar
*Attorney, Agent, or Firm*—Howard J. Greenwald

[57] ABSTRACT

An apparatus for producing spectrally different light distributions which have the same irradiance is disclosed. This apparatus contains a light source and an adjustable, opto-mechanical filter means. The filter means contains an adjustment means for simultaneously varying the spectral distribution of light passing through the filter while maintaining the flux of the light at a substantially constant irradiance level.

20 Claims, 8 Drawing Sheets

APPARTAUS FOR PRODUCING LIGHT DISTRIBUTIONS

CROSS-REFERENCE TO RELATED APPLICATION

This is a continuation-in-part of applicant's pending patent application 07/512,436, filed on Apr. 19, 1990.

FIELD OF THE INVENTION

An apparatus which can produce any specified light distribution such as, e.g., daylight, skylight, monochromatic light, and the like.

BACKGROUND OF THE PRIOR ART

Many attempts have been made to simulate natural daylight by artificial means. It has been claimed, with some justification, that natural daylight is the preferred lighted environment. Thus, for example, in form 00112 8809L 150M (1990), the Duro-Test Corporation (of 9 Law Drive, Fairfield, N.J.) states that a good simulation of natural daylight ". . . encourages people to perform as never before because it promotes good vision . . . People see better and work better . . ." Thus, in form 0090 (1988), the Duro-Test Corporation states that light which ". . . simulates natural daylight. . . " is ". . . the perfect interior lighted environment . . . "

One of the recognized experts on the use of color and its effects upon people, Mr. Carlto Wagner, has published a book entitled "Beyond Beautiful" (The Wagner Institute for Color Research, Santa Barbara, Calif., 1990). At page 38 of this book, he recommends that, when women are evaluating the colors of objects, they should "arrange them . . . under a good light source (daylight or bright incandescent lighting is best . . . ").

The standard spectrum for daylight is referred to in D. L. MacAdam's "Color Measuement: Theme and Variations" (Springer-Verlag, N.Y., 1981). In this book, the author refers to the CIE's $D_{65}$ illuminant.

It is desirable to be able to simulate other daylight spectra, besides the $D_{65}$ spectra. Thus, as is well known to those skilled in the art, the spectra of daylight will vary depending upon the daylight, upon atmospheric conditions, and solar altitude; see, e.g., S. T. Henderson's "Daylight and Its Spectrum," Second Edition (John Wiley & Sons, New York, 1977), the disclosure of which is hereby incorporated by reference into this specification.

There are devices known to the prior art which are capable of generating different spectral distributions; see, e.g., the device disclosed in German patent 1,744,824 of Karl. However, as the spectra generated by these devices change, the intensity of such spectra change.

For many applications, it is desirable that a sample be viewed under different spectral distributions at a substantially constant irradiance. Thus, for example, A.S.T.M. Standard D-1729-60T, entitled "Visual Evaluation of Color Differences in Opaque Materials," is often used for color matching of painted surfaces. The A.S.T.M. Standard requires that a specified opaque surface is to be viewed under different spectral conditions and that the irradiance of each of such condition be substantially constant. Thus, in section 5.1.2 of the Standard, it is provided that "For critical evaluation of color differences of materials of medium lightness, the illumination at the center of the viewed area shall be 100 to 125 foot-candles . . . In viewing very light materials, the illumination may be reduced to as low as 50 foot candles . . . and for very dark materials may be increased to as much as 200 foot candles . . . "

The device of the Karl patent is not capable of producing different spectral distributions at a substantially constant level of irradiance.

The prior art repeatedly suggests that, although different spectral distributions may be produced from a single light source and a multiplicity of filters, such distributions will have substantially different irradiances. Thus the "Kodak Color Darkroom Dataguide" (published by the Photographic Products Group, Eastman Kodak Company, Rochester, N.Y. 14650) discusses the adjustments one must make when developing prints using a single light source and different filters. At page 48 of this dataguide, in a paragraph entitled "Exposure Adjustments for Filter-Pack Changes," it is taught that "The overall density of a print is affected by changes in the number and density of the filters in the filter pack . . . For example, if you add 10M to the filter pack, increase exposure by 10 percent." The filter pack referred to in this quotation is mentioned at page 39 of the dataguide, in a paragraph entitled "Kodak Color Printing (CP) Filters" which states that "You place these acetate filters between the light source and the negative . . . When you change the filter pack, you can calculate exposure adjustments from the filter factors for the filters you add or remove."

Not everyone who uses darkroom apparatus has both the expertise, the time, and the patience to calculate correction factors for the differing spectral distributions which must be used to correctly expose a photographic print. Not everyone who uses color matching apparatus to view objects realizes the importance of viewing the objects with spectra which have substantially constant irradiances.

To the best of applicant's knowledge, the prior art did not provide an inexpensive, relatively uncomplicated apparatus which could automatically make the adjustments suggested in the Eastman Kodak dataguide. However, some extraordinarily complicated and expensive apparatuses have been designed which are suitable for similar purposes.

Thus, by way of illustration the Eastman Kodak Company has obtained several patents on complex electro-optical mechanical devices for exposing photographic products which require a substantial amount of sophisticated equipment, expertise, time, money, and patience to use.

Thus, for example, applicant's U.S. Pat. No. 4,922,089 (assigned to Eastman Kodak Company) describes an illumination source which is comprised of a spectroradiometer, a stepping motor, and a variable power supply. This device, which costs in excess of $300,000, must be used in conjunction with a sophisticated computer to control and continually adjust the elements of the device.

It is an object of this invention to provide an inexpensive device which can produce at least two different spectral distributions, each of which have substantially constant irradiance.

It is an object of this invention to provide a device which can be operated with only one control means to provide different spectral distributions with substantially constant irradiance from a light source.

It is an object of this invention to provide an adjustable filter means which, at different levels of adjustment, will provide different spectral distributions, each of which have substantially constant irradiance.

It is an object of this invention to provide a device which can provide different spectral distributions and substantially constant irradiance levels but at different illumination angles.

It is an object of this invention to provide a device which can provide spectra with different color temperatures but with substantially constant irradiance levels.

It is an object of this invention to provide a device which can provide spectra with a color temperature which is either greater than or less than the color temperature of the light source used in the device.

It is an object of this invention to provide a device comprised of an ultraviolet light source which can provide different spectral distributions and/or spectra with different color temperatures, wherein each of said spectra or spectral distributions have substantially the same irradiance level.

It is an object of this invention to provide a device which can simulate all possible daylight conditions, each with the same irradiance.

It is an object of this invention to accomplish one or more of the aforementioned objects with a relatively simple and inexpensive device which contains only one mechanical control means.

It is an object of this invention to accomplish one or more of the aforementioned objects with a device which contains an ultraviolet light source.

It is an object of this invention to accomplish one or more of the aforementioned objects with a device whose spectral output can be viewed at different angles of illumination.

It is an object of this invention to accomplish one or more of the aforementioned objects with a device equipped with means of shading ambient light from the device's viewing surface.

SUMMARY OF THE INVENTION

In accordance with this invention, there is provided an apparatus for generating a spectral distribution. This apparatus contains a light source and a single filter assembly. The filter assembly contains a filter and an adjustable aperture; as this assembly is adjusted, the spectral distribution of the light which passes through it varies, but the brightness and/or irradiance of such light is substantially constant.

DESCRIPTION OF THE DRAWINGS

The present invention will be more fully understood by reference to the following detailed description thereof, when read in conjunction with the attached drawings, wherein like reference numerals refer to like elements and wherein.

DESCRIPTION OF THE PREFERRED EMBODIMENT

Figure 1:
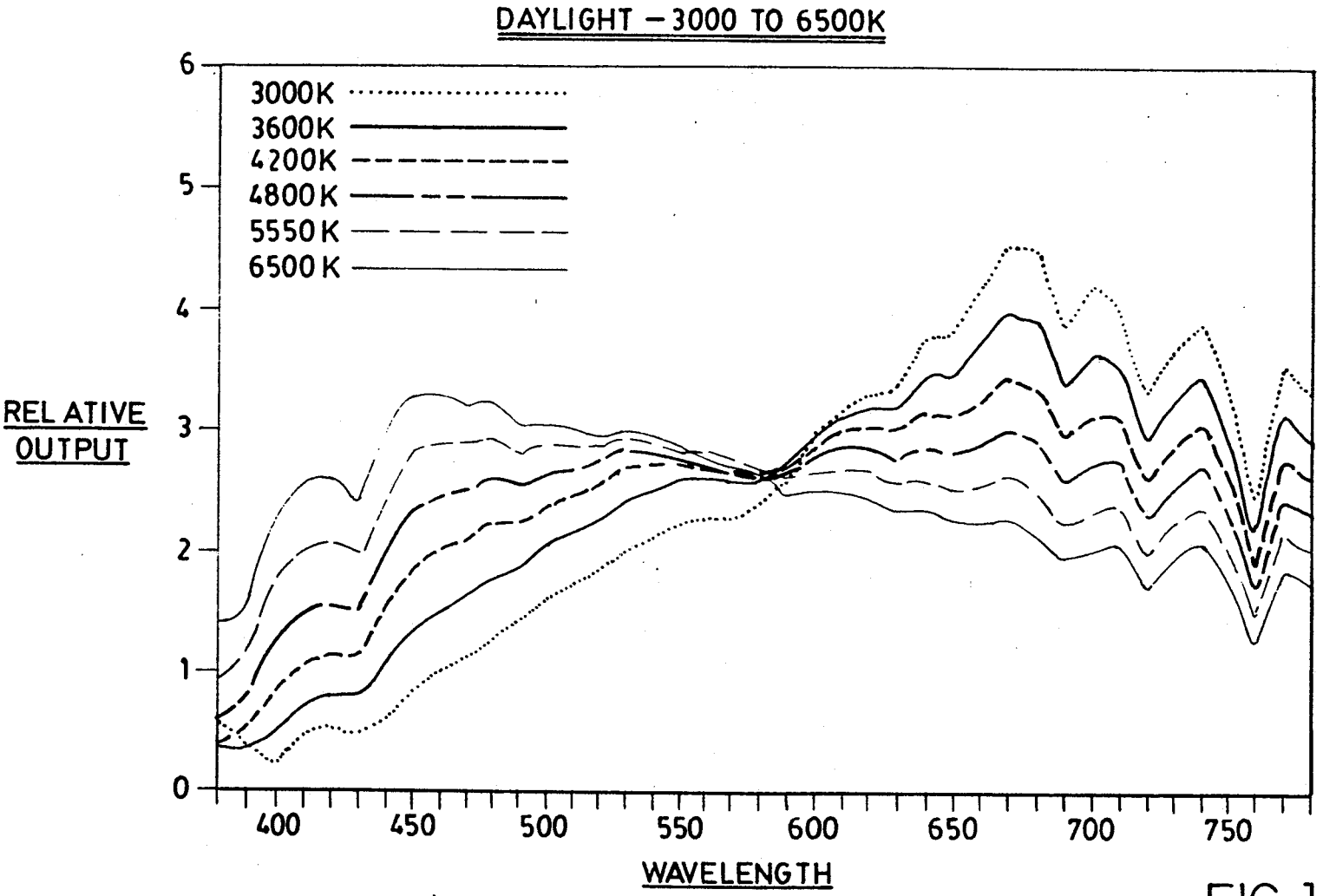
FIG. 1 is a graph of the spectral distribution of multiple daylight conditions of constant irradiance from 380 to 780 nanometers.

FIG. 1 contains several graphs of spectral distributions of daylight, over the range of wavelengths of from about 380 to about 780 nanometers. It should be noted that, although each spectral distribution has a different range of relative outputs, the irradiance of each of such spectral distributions is equal.

Referring to FIG. 1, it will be see that each spectral distribution plot corresponds to a light output with a specified color temperature. Thus, for example, the solid line plot corresponds to a daylight spectral distribution with a color temperature of 6,500 degrees Kelvin. At the other extreme, the dotted line plot corresponds to a daylight spectral distribution with a color temperature of 3,000 degrees Kelvin. These plots are merely illustrative and not limitative; it should be understood that daylight spectral distributions can have color temperatures less than 3,000 degrees Kelvin and greater than 6500 degrees Kelvin.

As used in this specification, the term color temperature refers to the temperature of a black body which has the same chromaticity as the test source.

For any give wavelength, the relative output of each daylight spectral distribution is plotted. The total integrated output of such spectral distribution is its irradiance. The irradiance is the radiant flux incident per unit area of a surface. Radiant flux is the rate at which radiant energy is transferred from one region to another by the radiation field.

The graph of FIG. 1 may be generated by measuring the individual irradiance of each of the daylight spectral distributions over the range of 380 to 780 nanometers.

Thereafter, by conventional means, the plots of the relative outputs of the different daylight spectral distributions may be generated.

The area defined by the plot of any of the spectral distributions will be equal to the area defined by the plot of any of the other spectral distributions; these areas may be calculated by conventional integration techniques.

Figure 2:
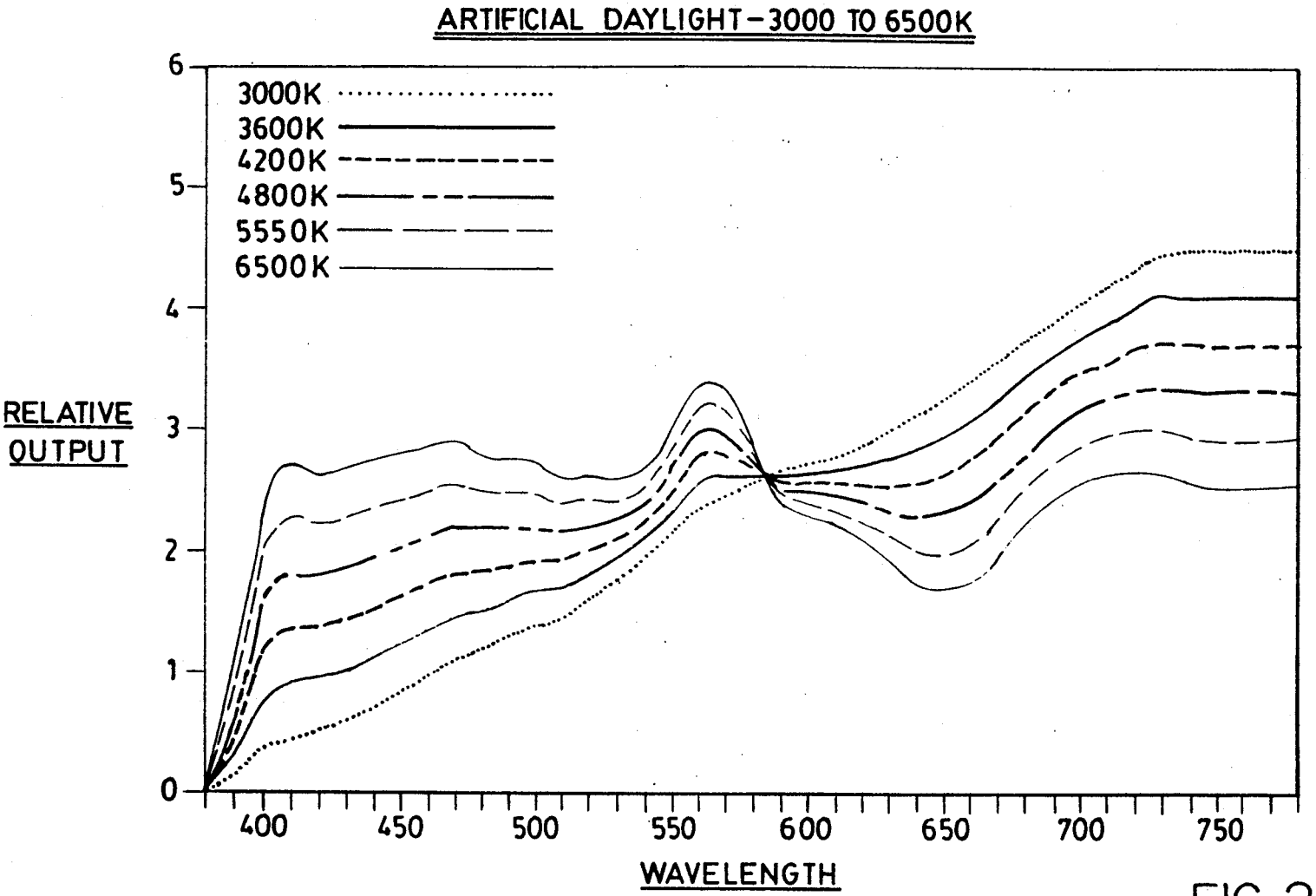
FIG. 2 is a graph of multiple simulated daylight spectral distributions of constant irradiance from 380 to 780 nanometers.

Referring to FIG. 2, similar plots of spectral distributions with various color temperatures which were produced by applicant's apparatus are shown. It should be noted that, like the spectral distributions of FIG. 1, each of the spectral distributions of FIG. 2 has an area defined by its plot which is equal to the area defined by the plot of any of the other spectral distributions of FIG. 2 and/or FIG. 1. Thus, unlike any of the prior art devices, applicant's apparatus is capable of changing the spectral distribution of its light output while maintaining the irradiance of such output at a substantially constant level.

Although FIGS. 1 and 2 describe the irradiance of spectral distributions which differ in their color temperatures, it should be understood that applicant's apparatus is capable of producing spectral distributions which differ in other respects (such as minus red characteristics, minus blue characteristics, etc.) but still have substantially the same irradiance.

It is believed that applicant's claimed apparatus is unique in its ability to continuously produce different spectral distributions with the same irradiance with only one mechanical control means. By moving one lever or control knob in his device, applicant is able to produce an infinite number of spectral distributions from a give light source; each of the distributions so produced, however, have the same irradiance.

Figure 3:
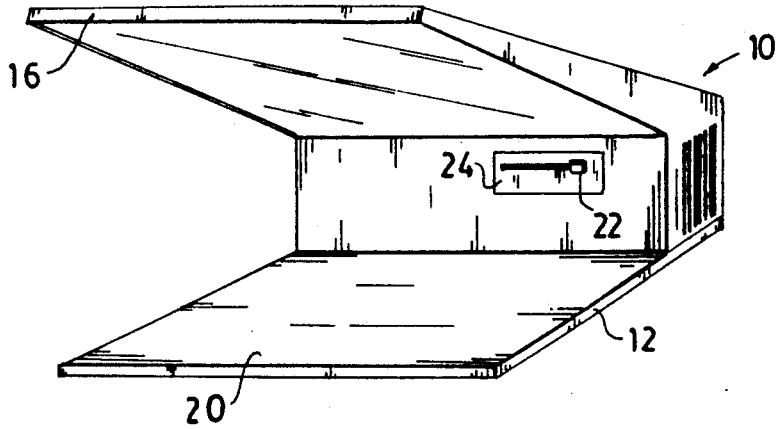
FIG. 3 is a perspective view of one preferred embodiment of the current invention.

Referring to FIG. 3, a preferred view of applicant's light generating apparatus 10 is shown. Light generating apparatus 10 is comprised of case 12.

Case 12 of light generating apparatus 10 may be constructed in any conventional manner of conventional material. It may be constructed from metal, plastic, glass, and the like. In one preferred embodiment, case 12 is constructed of sheet metal.

Case 12 defines a substantially U-shaped interior portion which comprises a hood 16, a lamp housing 18, and a base 20. The hood 16 is designed to minimize the amount of ambient light which contacts base 20. It is preferred that at least 96 percent of the ambient light which contacts apparatus 10 is shielded from base 20.

In one preferred embodiment, base 20 has a "gray paint" appearance, as defined by section 5.1.5.3 of the aforementioned A.S.T.M. Standard D-1729. This "gray paint" surface provides a gloss which is no greater than 15 on the 60-degree gloss scale (see A.S.T.M. Standard Test D523, "Specular Gloss").

Figure 4:
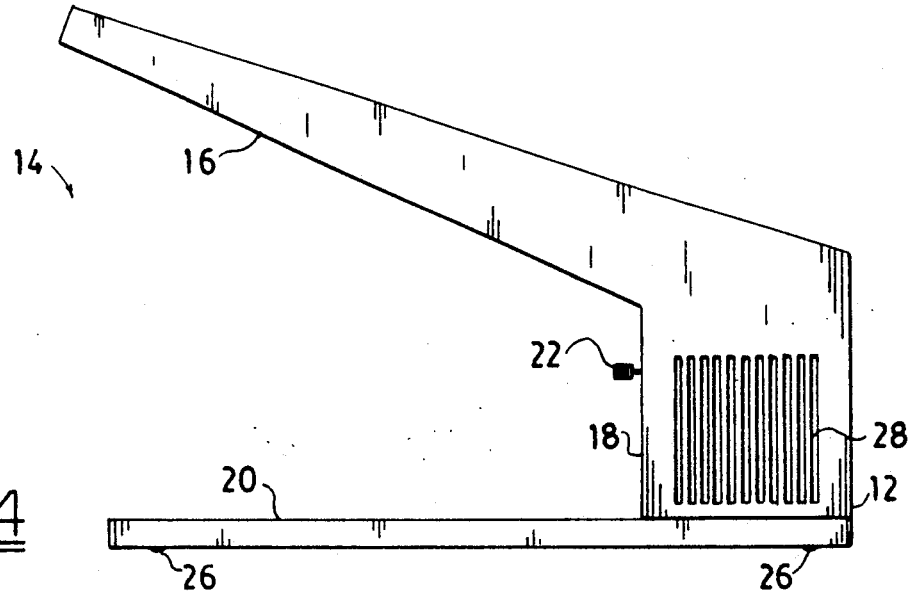
FIG. 4 is a side view of the embodiment of FIG. 3.
Figure 5:
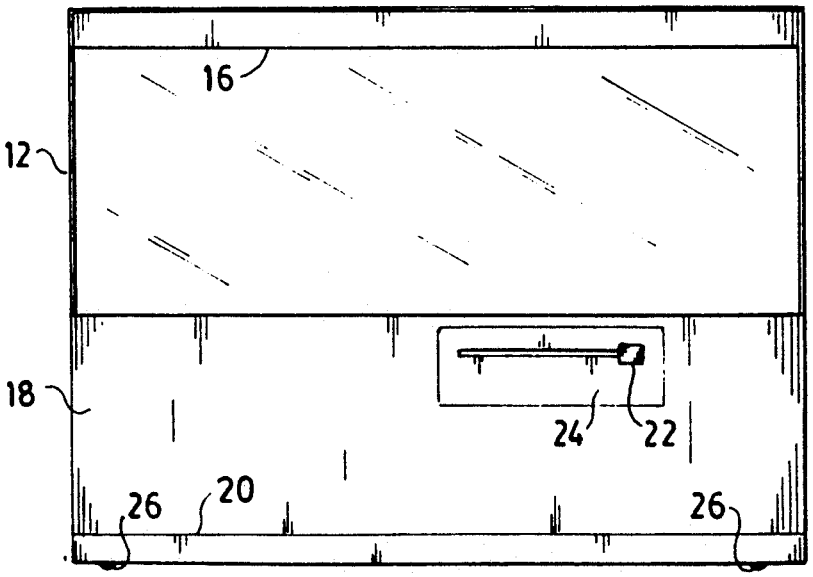
FIG. 5 is a front view of the embodiment of FIG. 3.

In the preferred embodiments illustrated in FIGS. 3, 4, and 5, apparatus 10 is comprised of control knob 22. By the use of this simple control knob, the spectral output of apparatus 10 may be varied while simultaneously maintaining the irradiance of such output at a constant level In the embodiment illustrated in FIG. 5, the control knob 22 is mounted in front of a template 24. As this knob is moved, it simultaneously varies the spectral characteristics of the light emitted from the hood 16 and indicates, by its position vis-a-vis template 24, what the spectral characteristics of such light are.

In the preferred embodiment illustrated in FIGS. 4 and 5, base 20 is attached to lamp housing 18 and hood 16 by a multiplicity of fasteners (not shown). The base 20 is preferably mounted on rubber feet 26 in order to minimize the amount of vibration transmitted to apparatus 10.

It is preferred that apparatus 10 comprise air vents, such as vents 28 (see FIG. 4) to allow air to flow in and out of apparatus 10. These air vents 28 may be formed in housing 18 by conventional means such as, e.g., by punching them out of the sheet metal, by lancing them, by louvering them, etc.

Figure 6:
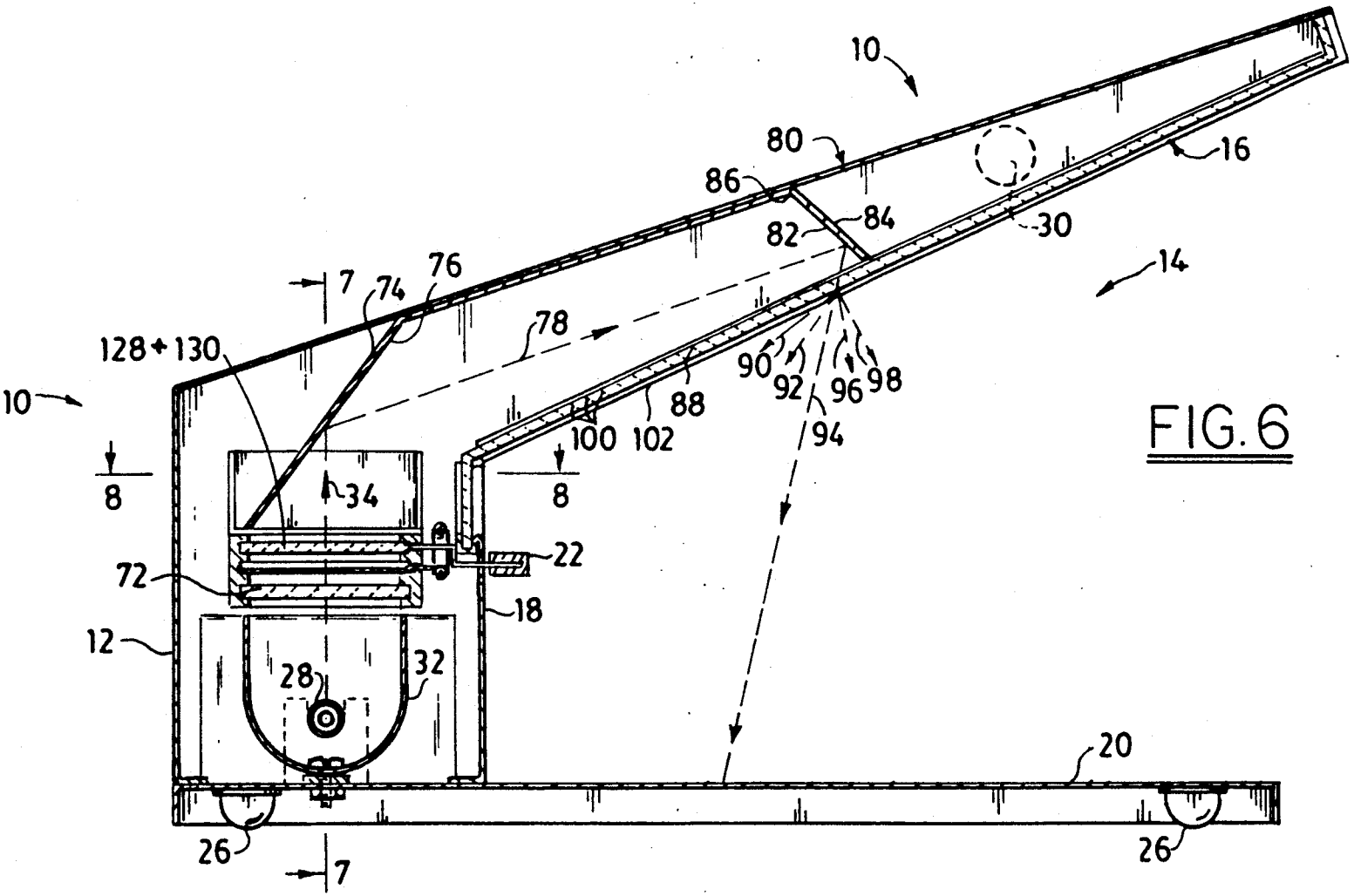
FIG. 6 is a side sectional view of the embodiment of FIG. 3.

FIG. 6 is a sectional view of the embodiment of FIG. 4. Referring to FIG. 6, it will been see that apparatus 10 is comprised of light source 28.

Light source 28 may be any light source which provides a full spectrum of light. As used in this specification, the term full spectrum of light is a spectrum which contains no voids. Thus, when a plot of the spectrum (in watts versus wavelength) is made, such plot will be a continuous line above the abscissa for a continuous spectrum of light.

Light source 28 is operatively connected to a power supply (not shown) which, preferably, delivers alternating current to the light source.

In one embodiment, apparatus 10 is also comprised of a second light source, light source 30 which provides a spectrum of light from about 10 nanometers to about 380 nanometers, thus providing light in the ultraviolet spectrum. In the same embodiment, the light source 28 preferably provides a continuous spectrum of light from about 380 to about 780 nanometers, providing visible light.

In one embodiment, an incandescent lamp which radiates energy at wavelengths between 380 nanometers to 1,000,000 nanometers is used as light source 28. Such a lamp is described at pages 55–59 of Volume 7 of the McGraw-Hill Encyclopedia of Science and Technology (McGraw-Hill Book Company, N.Y., 1977).

In another embodiment, a hydrogen lamp (also known as a deuterium lamp) which radiates energy at wavelengths between about 10 to about 380 nanometers may be used.

One may use any of the radiation sources known to those skilled in the art as light source 28. Thus, by way of illustration and not limitation, one may use any of the light sources described in U.S. Pat. No. 4,536,832 of Lemmons such as, e.g., the HMI metal halide lamp, the CSI metal halide lamp, the CID metal halide lamp, the carbon arc lamp, the mercury arc lamp, the xenon arc lamp, and the like. Thus, e.g., one may use fluorescent lamps. Thus, e.g., one may use the light sources described in U.S. Pat. No. 1,845,214 of Arrousez, U.S. Pat. No. 3,379,868 of Richardson, U.S. patent 2,057,278 of Richardson, and German Utility Model No. 1,744,824. The disclosure of each of said U.S. patents and of said German patent is hereby incorporated by reference into this specification.

Light source 28 may be comprised of only one lamp. Alternatively, light source 28 may be comprised of at least two lamps, each of which radiates a different light spectrum. In yet another embodiment, light source 28 is comprised of at least three lamps, each of which radiates a different light spectrum.

In another embodiment, only one lamp is used as light source 28 and it is a tungsten halogen lamp. These lamps are well known to those skilled in the art. Thus, for example, illuminant produced by these lamps (known as CIE illuminant A) is described on page 30 of D. L. MacAdam's "Color Measurement: Theme and Variation" (Springer-Verlag, N.Y., 1981). One preferred tungsten-halogen lamp is Sylvania's ANSI code FCL 58856, which is rated at 120 volts, has a color temperature of 3,000 degrees Kelvin, produces 10,000 lumens, and has filament class C8. Another preferred FCL lamp is a General Electric's "WATT-MISER QUARTZLINE" lamp, which contains an envelope around the filament which has a infrared reflective coating and reflects the infrared radiation back onto the filament, thereby reducing the energy required. One preferred bulb which might be used in the General Electric lamp is General Electric's Q500/350WM bulb.

It is preferred that light source 28 have a substantially constant output over its period of use; for every frequency, the output should be better than within 0.1 percent of the initial value.

It is preferred that the light source 28 be enveloped by a clear envelope rather than one which has a diffused surface.

Light source 28 is disposed near light reflecting element 32, which reflects the light rays from light source 28 upward in the direction of arrow 34.

In one embodiment, the light reflecting element 32 is a aluminum-coated reflector. Any aluminum-coated reflector 32 known to those skilled in the art may be used. Thus, by way of illustration and not limitation, one may use the reflectors described in William B. Elmer's "The Optical Desig of Reflectors," Second Edition (John Wiley and Sons, New York, 1980), the disclosure of which is hereby incorporated by reference into this specification. It is preferred that the reflector used be circular with a radius of about 1.0 inch and have sidewalls extending upwardly about 1.0 inch.

In one preferred embodiment, light reflecting element 32 consists essentially of annealed stainless steel and has a thickness of from about 0.050" to about 0.070".

It is preferred that the interior surface of light reflecting element 32 be sufficiently flat so that the angle between a reflected ray and the reflecting surface is equal and opposite to the angle of incident ray. The flatness of such interior surface may be measured by means well known to those skilled in the art. Thus, in one preferred embodiment, the interior surface of reflector 32 is a specular surface.

The term specular surface, as used in this specification, refers to a microscopically smooth and mirrorlike surface without any noticeable diffusion. See, for example, pages 25-26 of said Elmer book.

In one embodiment, light source 28 is so disposed in reflector 32 that a focused or partially focused beam of light 34 is directed toward filters 128 and 130. The focusing, or partial focusing, of light beam 34 allows one to minimize the size of filters 128 and 130.

Figure 7:
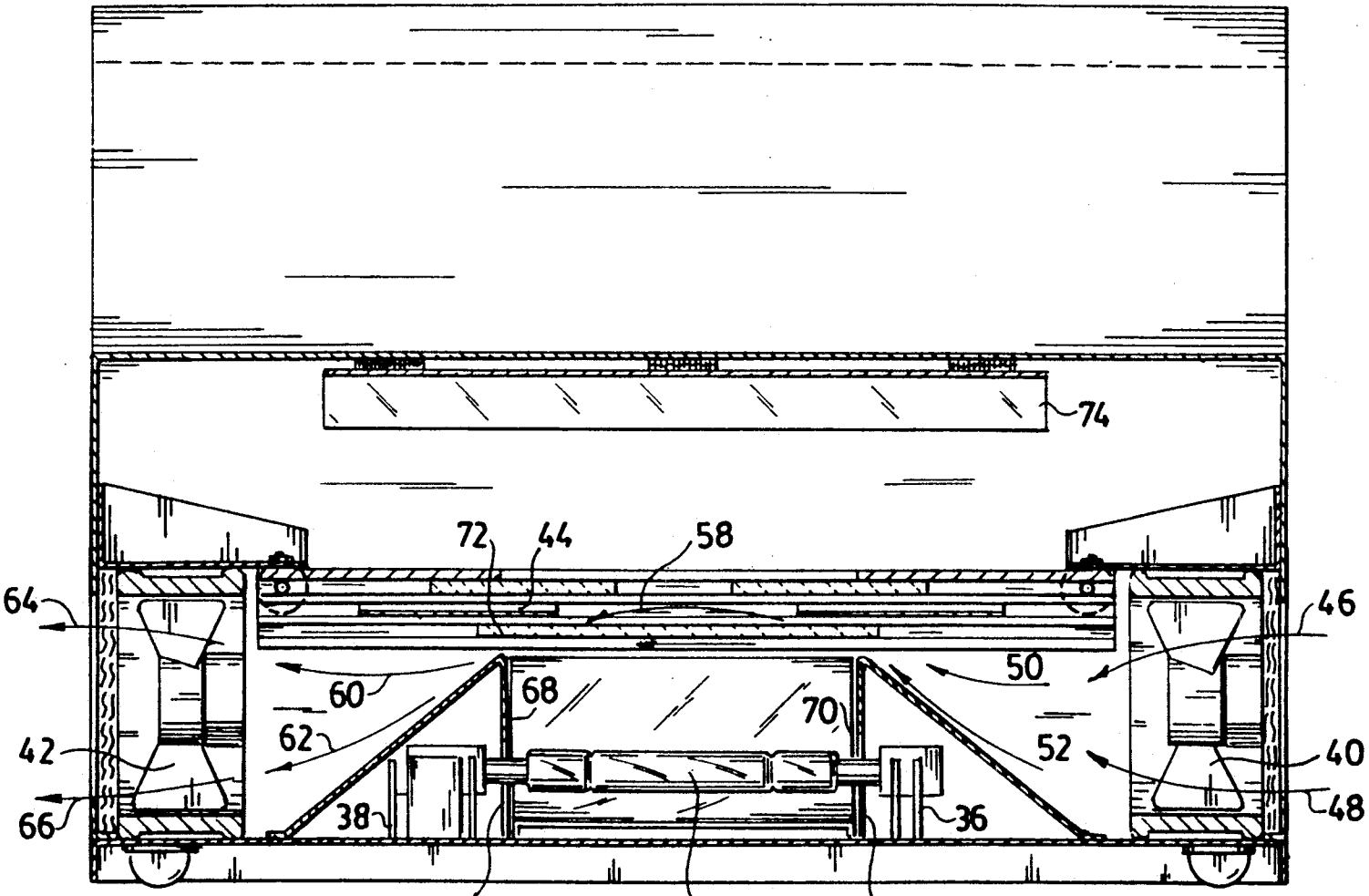
FIG. 7 is a front sectional view of the embodiment of FIG. 3

FIG. 7 is a partial sectional view of the front of applicant's preferred apparatus of FIG. 6, take along lines 7—7. Referring to FIG. 7, the light source 28 is captured by sockets 36 and 38.

Referring again to FIG. 7, it is preferred that light generating apparatus 10 also comprise fans 40 and 42.

These fans preferably blow air across filter extrusion 44 to keep the optics housed by it cool. The air preferably flows in the direction of arrows 46 and 48; it contacts inverted V-shaped reflectors 54 and 56 and thereby flows in the direction of arrows 58, 60, 62, 64, and 66. Furthermore, in addition to directing the flow of air, the inverted V-shaped members 54 and 56 also function as does reflector 32. One of the primary function of reflector 32 is to assist in the mixing of filtered and unfiltered light in hood 16.

It is preferred that V-shaped members 54 and 56 each contain at least one specular surface. In the preferred embodiment illustrated in FIG. 7, each of said V-shaped members contains such specular surface on its surface closest to light source 28. Thus, interior surface 68 of V-shaped member 56 is specular, as is interior surface 70 of V-shaped member 54.

The polychromatic light rays from lamp 28 are preferably caused to impinge upon heat reflecting means 72. The function of heat reflecting means 72 is to reflect the infrared radiation generated by light source 28 downward back toward said light source. As known to those skilled in the art, such infrared radiation generally has a wavelength of from about 780 to about 1,000,000 nanometers. Thus, the light passing through heat reflecting means 72 will preferably have a wavelength of from about 380 to about 780 nanometers.

Any means well known to those skilled in the art may be used to remove the infrared radiation from the light. Thus, by way of illustration, one may use an optical glass filter. One suitable optical glass filter is a IRR Pyrex glass filter (sold by the F. J. Gray Company, 139-24 Queens Blvd., Jamaica, N.Y. 11435).

In the preferred embodiment illustrated in FIG. 7, the heat reflecting means 72 is preferably mounted in the filter extrusion 44.

Referring again to FIG. 6, light from light source 28 is guided by reflector 32, and by surfaces 68 and 70 (seen FIG. 7) upwardly in the direction of arrow 34, whereby it impinges upon reflector 74. The interior surface 76 of reflector 74 preferably has the same reflective characteristics as don the surfaces of reflectors 32, 68, and 70, i.e., such surface 76 is preferably specular.

Reflector 74 is disposed within hood 16 in such a manner that light ray 78 reflected from the surface 76 of reflector 74 is directed approximately parallel to top surface 80 of hood 16 and thereby impinges upon the interior surface 82 of reflector 84. Interior surface 82 of reflector 84 also preferably is specular.

Reflector 84 is movable, being hingably attached to surface 80 of hood 16 at point 86. A external lever (not shown) may be attached to reflector 84 to vary the angle of reflection of light ray 78. Thus, referring again to FIG. 6, the light ray 78 may be caused to exist through orifice 88 of hood 16 in any of directions 90, 92, 94, 96, 98, and the like.

In another embodiment, not shown, reflector 74 is so disposed within hood 16 that light ray 78 is caused to impinge upon multiple reflective blades 100. These reflective blades are adjustably and hingably attached to surface 102 of hood 16 so that the light reflected from them may be directed in a multiplicity of different directions, such as directions 90, 92, 94, 96, and 98. In this embodiment, it is preferred that reflective blades be disposed along the entire length of surface 102. It is preferred that the surfaces of these reflective blades 100 be specular.

In one preferred embodiment, surface 102 is comprised of acrylic material which, preferably, has a diamond-patterned surface impregnated into it.

Figure 8:
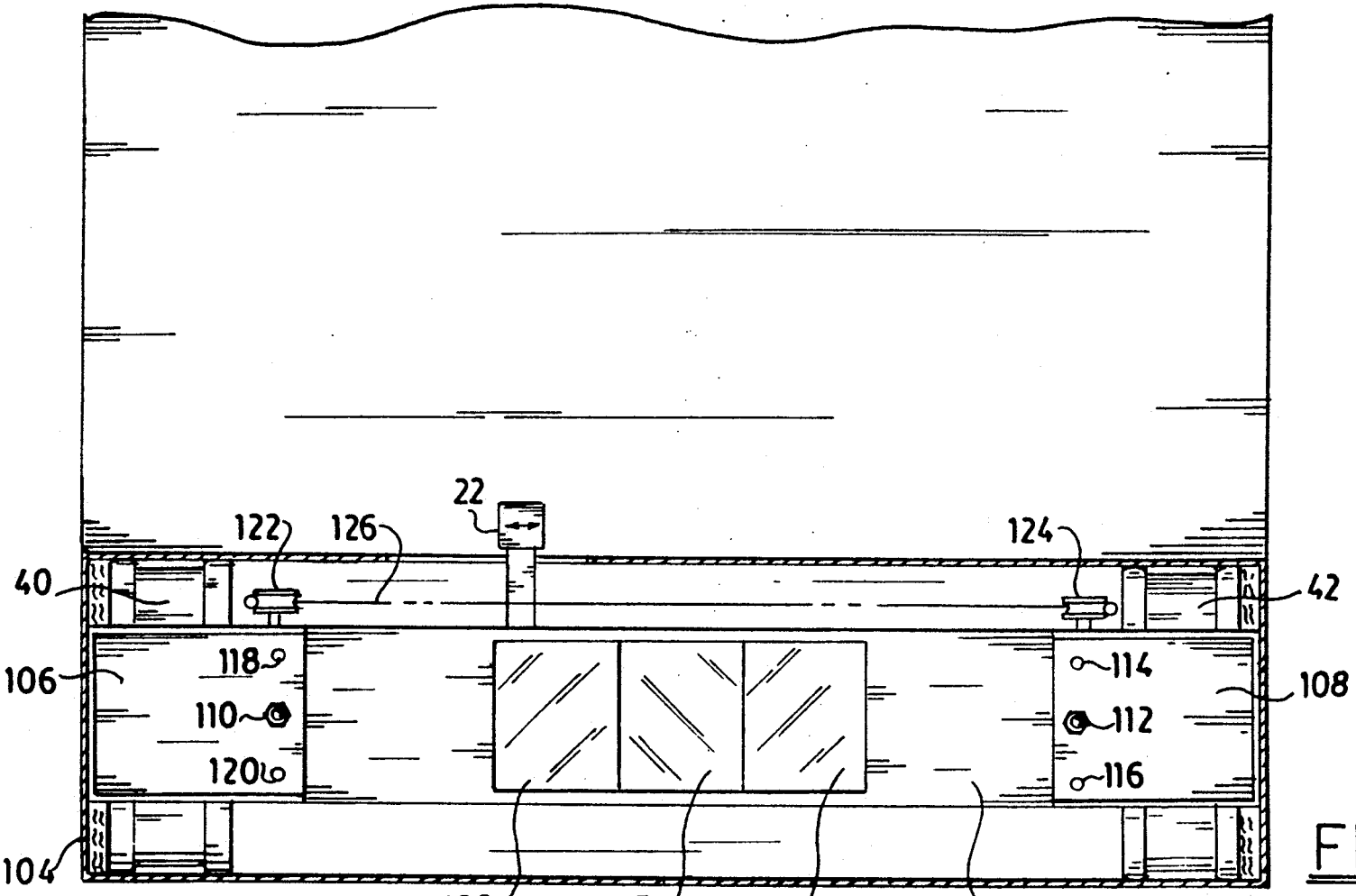
FIG. 8 is a top view of a preferred filter extrusion used in the embodiment of FIG. 3.

FIG. 8 is a partial sectional view of the top of the apparatus of FIG. 6, take along lines 8—8. Referring to FIG. 8, it will be seen that, in this embodiment, filter extrusion assembly 44 is attached to hood surface 104 by brackets 106 and 108.

It is preferred to attach brackets 106 and 108 to surface 104 by conventional means. Thus, said brackets 106 and 108 may be welded to surface 104.

Extrusion assembly 44 may be attached to brackets 106 and 108 by conventional means. Thus, by way of illustration, and referring to FIG. 8, they may be attached by bolts 110 and 112 and corresponding nuts. Furthermore, as indicated in FIG. 8, they may also be aligned by tabs 114, 116, 118, and 120.

Referring again to FIG. 8, it will be seen that control knob is operatively connected to pulleys 122 and 124 by cable 126; and movement of the control knob in a left or right direction results in rotation of said pulleys 122 and 124. Furthermore, control knob 22 is also directly connected to filter 128 and thereby moves said filter in a corresponding left or right direction.

Filter 130 is movably attached to filter 128 through cable 126, and it moves in a direction opposite to that of filter 128. Thus, when filter 128 moves left, filter 130 moves right.

It will be apparent to those skilled in the art that applicant's device 10 is relatively uncomplicated and inexpensive. It is preferred that the filter assembly in be one that is an unmotorized, opto-mechanical apparatus, as distinguished from the motorized, electro-opto-mechanical device of the aforementioned Eastman Kodak Company patent.

The filter assembly in applicant's device is preferably unmotorized. As is known to those skilled in the art, a motorized device is one that is equipped with a motor, i.e., a device which imparts or produces mechanical motion through, e.g., the conversion of electrical energy into mechanical energy.

Applicant's device is comprised of an adjustable, opto-mechanical filter assembly which is unmotorized and neither contains requires an electrical circuit. This simplicity and versatility of this opto-mechanical filter means allows for the simplicity and versatility of applicant's device.

Figures 9, 10, 11:
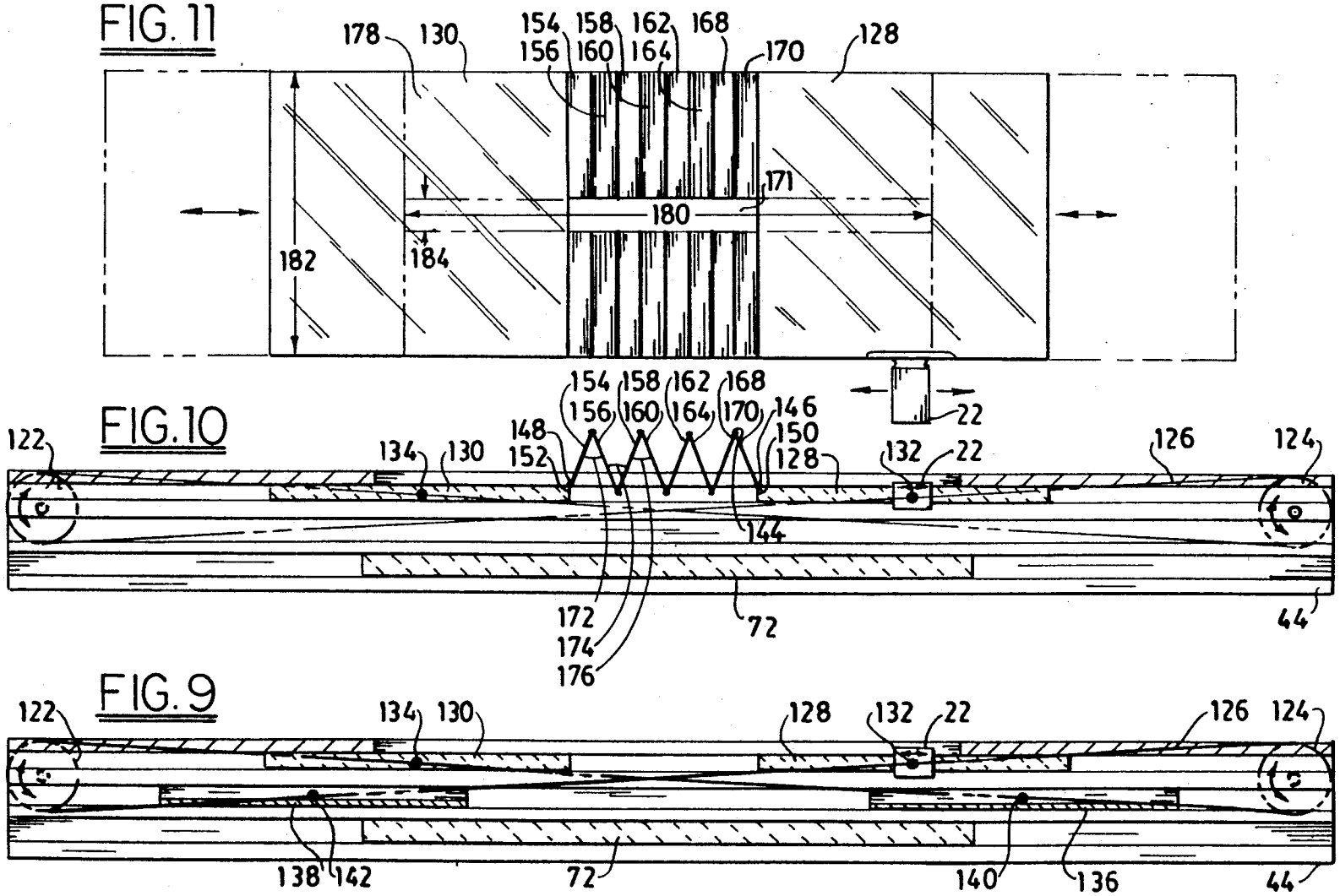
FIG. 9 is a side view of a filter extrusion similar to that depicted in FIG. 8.
FIG. 10 is a side view of another filter extrusion similar to that depicted in FIG. 8.
FIG. 11 is a top view of the filter extrusion of FIG. 10.

FIG. 9 illustrates one embodiment of a filter assembly which is capable of producing different spectral distributions and which, at its two extremes, produces spectral distributions with substantially constant irradiance.

The embodiment of FIG. 9 is similar to the embodiment of FIG. 8. Thus, like the latter embodiment, the embodiment of FIG. 9 is comprised of pulleys 122 and 124 which are connected by cable 126 to control knob 22. Control knob 22 is also directly connected to filter 128. Thus, when the control knob 22 is moved in a left or right direction, it causes cable 126 to move, filter 128 to move in a left or right direction, and pulleys 122 and 124 to rotate in a counterclockwise and clockwise direction.

The cable 126 is dispoed within the extrusion assembly 44 in the shape of a "FIG. 8." As is show in FIG. 9, both filters 128 and 130 are attached to cable 126 at the top portion of the "FIG. 8", points 132 and 134. Thus, movement of control knob 22 moves both the filter 128, the cable 126, and as a result of the cable's motion, also moves filter 130, pulley 122, and pulley 124. Furthermore, as described below, the movement of the control knob also moves shutters 136 and 138.

Referring again to FIG. 9, it will be seen that the shutters 136 and 138 are attached at the bottom of the "FIG. 8," at points 140 and 142. Because they are attached at the bottom of the "FIG. 8," when the filters 128 and 130 move inwardly, the shutters 136 and 138 move outwardly, and vice versa.

In the embodiment of FIG. 8, infrared filter 72 is stationary. Thus, by moving the control knob 22, one automatically varies the amount of light allowed in by the shutters, and the amount of light affected by the filters.

The embodiment of FIG. 10 is similar to the embodiment of FIG. 9, but it is substantially superior: unlike the embodiment of FIG. 9, each and every spectral distribution which is produced by the embodiment of FIG. 10 has substantially the same irradiance.

Like the embodiment of FIG. 9, the embodiment of FIG. 10 is comprised of pulleys 122 and 124 which are connected by cable 126 to control knob 22. Control knob 22 is also directly connected to filter 128. Thus, when the control knob 22 is moved in a left or right direction, it causes cable 126 to move, filter 128 to move in a left or right direction, and pulleys 122 and 124 to rotate in a counterclockwise and clockwise direction.

The cable 126 is in the form of a "FIG. 8". As is shown in FIG. 10, both filters 128 and 130 are attached to cable 126 at the top portion of the "FIG. 8", points 132 and 134. Thus, movement of control knob 22 moves both the filter 128 and the cable 126, and as a result of the cable's motion, also moves filter 130, pulley 122, and pulley 124.

The embodiment of FIG. 10 differs from that of FIG. 9 in that the former embodiment is comprised of a flexible shutter 144 which is hingably attached at points 146 and 148 to the interior surfaces 150 and 152 of filters 128 and 130. As the filters 128 and 130 are caused to move towards each other by the movement of control knob 22, the shutter is compressed.

The flexible shutter 144 is comprised of a multiplicity of light-attenuating segments 154, 156, 158, 160, 162, 164, 168, and 170; it also, in one embodiment, may contain a slit 171 (seen FIG. 11) through which light may pass. The compression of the flexible shutter 144 causes the angle between adjacent light-attenuating segments to decrease. Thus, by way of illustration, as the shutter is compressed angles 172, 174, and 176 are decreased. This compression, and the corresponding decrease in such angles, causes the sections of the flexible shutter to tend to become substantially parallel to ray 34 (seen FIG. 6). When the shutters are substantially parallel to ray 34, they present a smaller barrier to the passage of such ray. On the other hand, when the flexible shutter is expanded, the angles between the shutter sections increase, the shutter sections tend to become substantially perpendicular to ray 34 (seen FIG. 6), and they present a larger barrier to the passage of such ray.

Any of the materials which are so composed and/or constructed so that they allow light to pass through them without changing its spectral composition may be used to construct flexible shutter 144. Thus, by way of illustration, flexible shutter 144 can consist essentially of neutral density materials such a neutral density glass, vapor deposited metals on clear substrate, opaque materials with large or small hole(s) punched in them, and the like.

In one embodiment, flexible shutter 144 is comprised of opaque material. In this embodiment, it is preferred that the opaque material be heat resistant and reflect rather than absorb radiation.

The flexible shutter 144 may be integral, consisting of one piece. Alternatively, it may comprise many pieces.

Referring to FIG. 11, it will be seen that flexible shutter 144 may be comprised of a slit 171 oriented along the longitudinal axis of light source 28. It will be apparent to those skilled in the art that, as flexible shutter 144 is compressed, the length 180 of the slit 171 will decrease, thereby decreasing the opportunity for light to pass through the shutter. On the other hand, as the flexible shutter 144 is expanded, the length 180 of the slit 171 will increase.

In the preferred embodiment wherein the shutter 144 is comprised of slit 171, the optimum width 184 of the slit 171 may be calculated in accordance with the procedure described below.

The average transmission of filters 128 and 130 is multiplied by the aperture width 182 of aperture 178. The resulting number is a good approximation of the optimum slit width 184 of slit 171, assuming that the maximum length of the slit is equal to the aperture length 180.

There is yet another means of approximating the optimum slit width, even if the transmission of the filters 128 and 130 are unknown. In this second process, a measurement of the irradiance of the viewing plane is take with the filters 128 and 130 fully in place, the irradiance of the viewing plane is the take without filters 128 and 130 in place, the former irradiance is divided by the latter irradiance, and this quotient is multiplied by the width 182 of the aperture 178, assuming that the maximum slit length is equal to the aperture length 180.

There is yet another means of determining the optimum slit width. The irradiance of the lamp with filters 128 and 130 in place is first determined, then, without such filters in place, the irradiance is adjusted with a shutter with a adjustable slit width so that the irradiance obtained is equal to the irradiance with filters 128 and 130 in place. The slit width thus obtained is the optimum slit width.

If constant irradiance is sought, the measuring device used may be a commercially available radiometer. If constant brightness is desired, the the measuring device may be a commercially available photometer. Both of these measuring devices may be obtained, e.g., from International Light Inc., Dexter Industrial Green, Newbury Point, Mass. 01950.

Referring again to FIG. 10, when flexible shutter 144 is compressed, filters 128 and 130 will be pulled toward the center of filter extrusion 44 and thus occupy most of the area of the clear aperture 178 (seen FIG. 11). Thus, although the compression of shutter 144 will tend to allow more of the light through, the movement of the filters 128 and 130 to cover more of the aperture 178 and their ability to modify the spectral output of the light source 28 will correspondingly allow an overall constant amount of light to pass through the aperture 178. Similarly, when the flexible shutter 144 is expanded (and tends to allow less of the light through than an otherwise open aperture), the filters 128 and 130 will move out of the clear aperture, thereby allowing a constant amount of light to pass through the aperture 178.

One feature in common to the embodiments described above is the ability of such devices to simultaneously vary the amount of spectral distribution produced by the device and the flux in such spectral distribution. As is known to those skilled in the art, flux is the time rate flow of energy; it also is the radiant or luminous power in a beam.

It will be apparent to those skilled in the art that many different means may be used to affect the flux and spectral distribution of a light beam. Thus, e.g., one may vary the slit length in a shutter. Thus, e.g., one may vary the slit width in a shutter. Thus, e.g., one may use a shutter which does not contain a slit, in which case one may vary the size and/or number of orifices in the shutter.

Thus, e.g., one may cover some or all of the orifices and/or slit(s) in a shutter with attenuating means. Thus, e.g., one may change the configuration of all or part of the shutter assembly vis-a-vis the light beam, thereby affecting the degree to which the light impinges upon the shutter. Many other means of affecting the flux of a light beam will be apparent to those skilled in the art.

Figure 13:
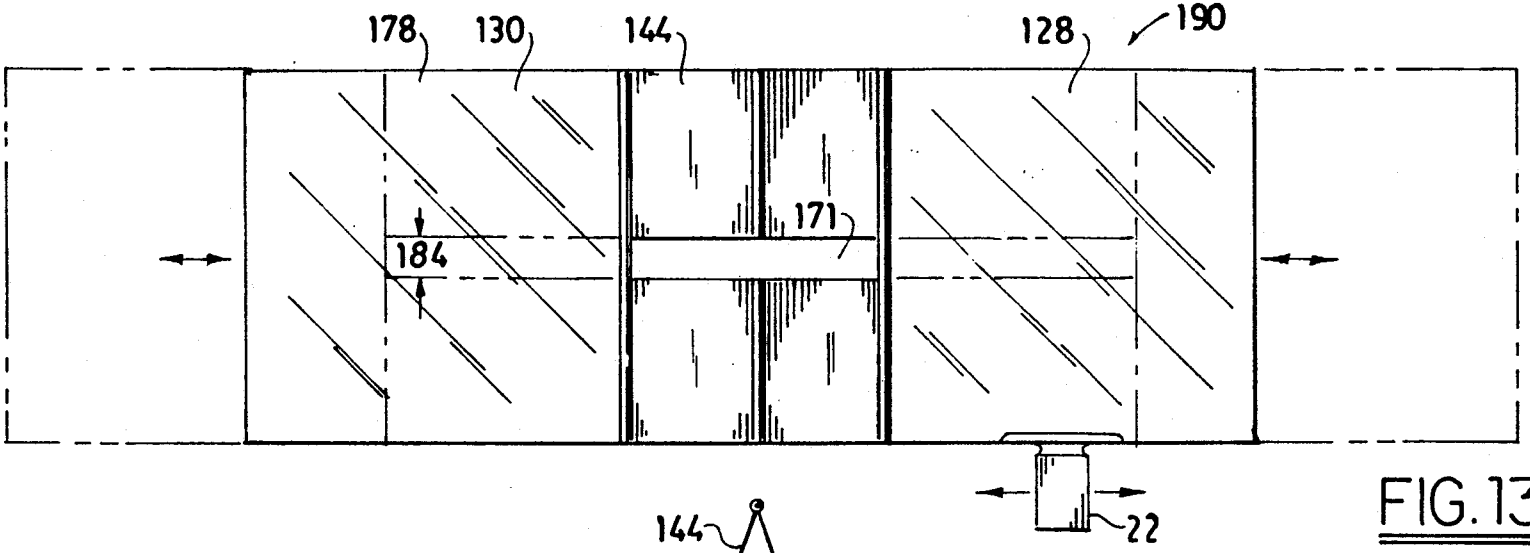
FIG. 13 is a top view of the filter extrusion of FIG. 12.
Figure 12:
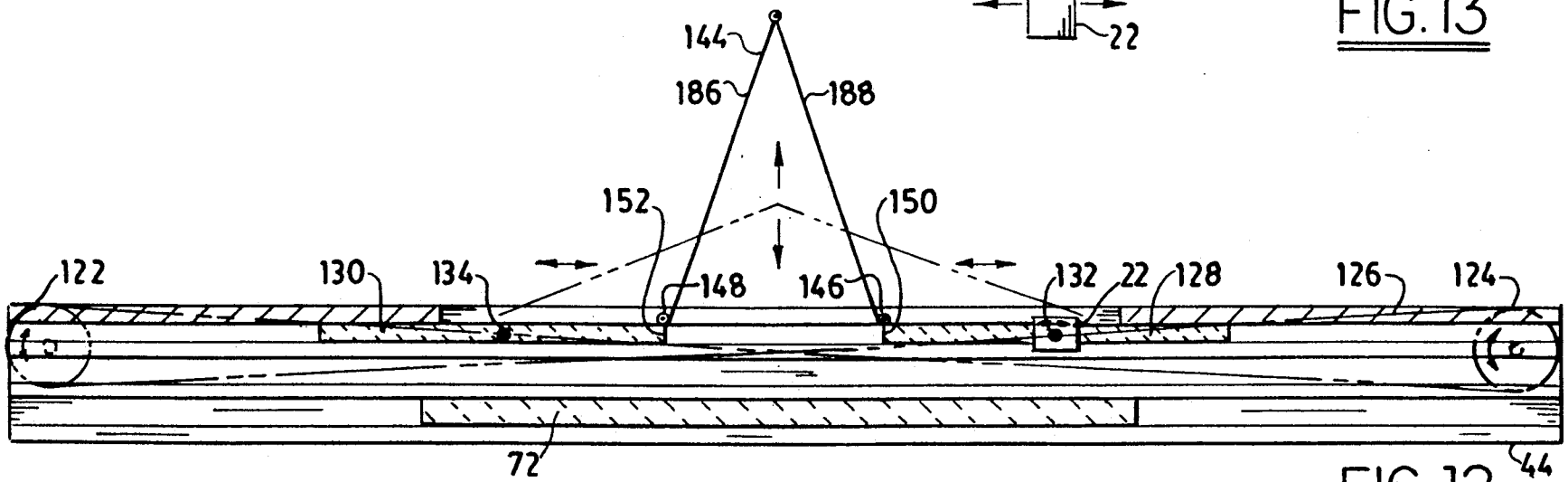
FIG. 12 is a side view of another filter extrusion similar to that depicted in FIG. 8.

FIGS. 12 and 13 describe an embodiment similar to that described in FIGS. 10 and 11 but differing therefrom in the construction of the shutter 144. The shutter apparatus in the device of FIGS. 12 and 13 is comprised of shutter material which may be, e.g., either filter glass and/or opaque material. The shutter is preferably comprised of at least two sections (section 186 and 188), although fewer or more sections also may be used.

In the embodiment (not shown) where only one section is used, the shutter will consist of a material which will be hingably attached at its ends to the movable filter 128.

In the embodiment show in FIGS. 12 and 13, where the shutter material is comprised of two sections (sections 186 and 188), each of these sections is hingably attached at its bottom to either filter 128 or filter 130; shutter section 186 is hingably attached at its bottom to filter 130 (at surface 152) and also is preferably hingably attached at its top to shutter section 188; and shutter section 188 is hingably attached at its bottom to filter 128 (at surface 150) and also is preferably hingably attached at its top to shutter section 186.

It will be apparent to those skilled in the art that the shutter may contain three or more sections of shutter material, which may be the same or different.

In one preferred embodiment, illustrated in FIG. 13, the filter assembly 44 is comprised of a slit 171 which functions in the manner described above. As the shutter assembly 144 is compressed, the length of the slit is compressed, and the shutter is raised into a substantially parallel position vis-a-vis the ray 34.

In one preferred embodiment, also illustrated in FIG. 13, the shutter assembly is comprised of filter glass. In another embodiment, not shown, the slit 171 is partially or completely covered with filter glass. In either of these embodiments, the use of a filter glass in the shutter assembly 144 with properties different from the filter glass in filter 128 and/or 130 allows one to adjustably affect the color temperature of the light transmitted through the filter assembly 190. As the shutter is compressed, e.g., the length of the slit 171 decreases, and the amount of light that impinges upon the filter glass in the shutter assembly 144 decreases, and the amount of light that impinges upon the glass in filters 128 and 130 increases. Conversely, as the shutter is expanded, relatively more light impinges upon the glass in the shutter assembly, and relatively less light impinges upon the glass in filters 128 and 130. Thus, by making a simple adjustment with control knob 22, one may affect the color temperature of the light being produced by apparatus 10.

Applicant's claimed apparatus 10 may be constructed by conventional means using commercially available materials. Thus, by way of illustration and not limitation, the hood 16, the lamp housing 18, and the base 20 may be made out of cold rolled steel with a thickness of 0.047 inches. Thus, e.g., referring to FIG. 6, the lens cover 102 may be made from a sheet of acrylic material with a diamond patter in it which is about 0.125"; it preferably has an ultraviolet light inhibitor in it.

Referring to FIG. 11, the filters 128 and 130 may be made from Hoya LB-120 glass which is 0.150 inches thick x 2.150 inches long×2.150 inches wide.

Referring again to FIG. 11, shutter 144 may be made from 0.003" to 0.005" thick aluminum, folded forty times in a corrugated shape, each section being 0.150" long by 2.20" wide with a slit 0.390" wide. In the embodiment show in this Figure, both the filter and shutter either jointly or independently cover the entire clear aperture of the light source.

In one embodiment, not shown, the structure of FIGS. 12 and 13 is operatively connected to a control which allows one to increase or decrease the effective slit width 171 of shutter 144. Thus, by varying the slit width and/or the slit length and/or the angle of incidence between the shutter and the light source, one may obtain a substantially infinite number of levels of irradiance for a specified spectral distribution.

In one preferred embodiment, not shown, the filters 128 and 130, and/or the shutter assembly 144, are operatively connected to control knob 22 with a thread and nut system rather than with the pulley and cable system disclosed in the drawings. In the former system, the thread driving one filter also drives a second thread in a reverse rotation, via an intermediate coupling, which is in turn attached to a second filter.

Referring to FIGS. 12 and 13, the color correcting glass which may be used to cover slit 171, such filter may be made from Hoya LA-120 glass, which is 0.150 inches thick.

Although applicant has very specifically described many aspects of his invention, many other modifications will suggest themselves to those skilled in the art upon a reading of this disclosure. These are intended to be comprehended within the scope of this invention.

In claim:

1. A apparatus for continuously producing at least two spectrally different light distributions possessing substantially the same irradiance, wherein said apparatus is comprised of a light source for providing light and a adjustable, opto-mechanical filter means for attenuating light from said light source, wherein said adjustable, opto-mechanical filter means is comprised of:

1. opto-mechanical means for simultaneously varying the flux and the spectral distribution of light which passes through said opto-mechanical means; and
2. opto-mechanical adjustment means for simultaneously varying said spectral distribution of said light which passes through said opto-mechanical means while maintaining said flux of said light which passes through said opto-mechanical device at a substantially constant irradiance level, wherein said opto-mechanical adjustment means does not comprise an electrical circuit.

2. The apparatus as recited in claim 1, wherein said apparatus is comprised of reflector means for guiding light from said light source.

3. The apparatus as recited in claim 2, wherein said opto-mechanical adjustment means is unmotorized.

4. The apparatus as recited in claim 3, wherein said apparatus is comprised of a hood.

5. The apparatus as recited in claim 4, wherein said hood shields at least about 96 percent of the ambient light which contacts said apparatus.

6. The apparatus as recited in claim 5, wherein said light source provides a full spectrum of light.

7. The apparatus as recited in claim 6, wherein said apparatus is comprised of at least two light sources, at least one of which emits ultraviolet light.

8. The apparatus as recited in claim 6, wherein said apparatus is comprised of means for ventilating said apparatus.

9. The apparatus as recited in claim 8, wherein said means for ventilating is comprised of at least one fan.

10. The apparatus as recited in claim 9, wherein said apparatus is comprised of at least one inverted-V shaped reflector.

11. The apparatus as recited in claim 10, wherein said opto-mechanical adjustment means is comprised of at least one optical glass filter.

12. The apparatus as recited in claim 11, wherein at least one of said reflectors is adjustable.

13. The apparatus as recited in claim 12, wherein said opto-mechanical adjustment means is comprised of a cable and at least two pulleys.

14. The apparatus as recited in claim 13, wherein said opto-mechanical adjustment means is comprised of a movable shutter operatively attached to said optical glass filter.

15. The apparatus as recited in claim 14, wherein said movable shutter is comprised of a multiplicity of light-attenuating segments and is collapsible.

16. The apparatus as recited in claim 15, wherein said movable shutter is comprised of at least one orifice.

17. The apparatus as recited in claim 1, wherein said opto-mechanical adjustment means is housed in a body which consists essentially of extruded metal.

18. The apparatus as recited in claim 14, wherein said shutter is comprised of filter glass.

19. The apparatus as recited in claim 18, wherein said filter glass is color-correcting filter glass.

20. The apparatus as recited in claim 1, wherein said opto-mechanical adjustment means is comprised of a control knob operatively connected to said opto-mechanical filter means.

* * * * *